United States Patent [19]

Sluys

[11] Patent Number: 4,470,365

[45] Date of Patent: Sep. 11, 1984

[54] CONCRETE MARINE FLOAT HAVING UTILITY DISTRIBUTION SYSTEM

[75] Inventor: Wesley W. Sluys, Bellingham, Wash.

[73] Assignee: Builders Concrete, Inc., Bellingham, Wash.

[21] Appl. No.: 359,084

[22] Filed: Mar. 17, 1982

[51] Int. Cl.[3] ..... B63B 35/38

[52] U.S. Cl. ..... 114/266; 114/267; 405/218; 405/219

[58] Field of Search ..... 114/266, 267; 405/218, 405/219, 220, 221

[56] References Cited

U.S. PATENT DOCUMENTS

| | | | |
|---|---|---|---|
| 3,448,709 | 6/1969 | Hardwick, Jr. | 114/266 |
| 4,252,470 | 2/1981 | Sluys | 405/219 |
| 4,263,865 | 4/1981 | Shorter, Jr. | 114/266 |
| 4,353,320 | 10/1982 | Sluys | 405/219 |

*Primary Examiner*—Trygve M. Blix
*Assistant Examiner*—Ivy M. Shum
*Attorney, Agent, or Firm*—Seed and Berry

[57] ABSTRACT

A concrete marine float having a deck plate which is substantially wider than the width of the underlying casing in order to form overhanging flanges on opposite sides of the float. The flange is supported by longitudinally spaced gussets which extend from the sidewalls of the float to the underside of the deck. Utility conduits extending along the float beneath the flanges pass through the gussets and are thereby supported. The utility conduits pass upwardly through the deck to communicate with conventional utility outlets mounted on the deck.

15 Claims, 4 Drawing Figures

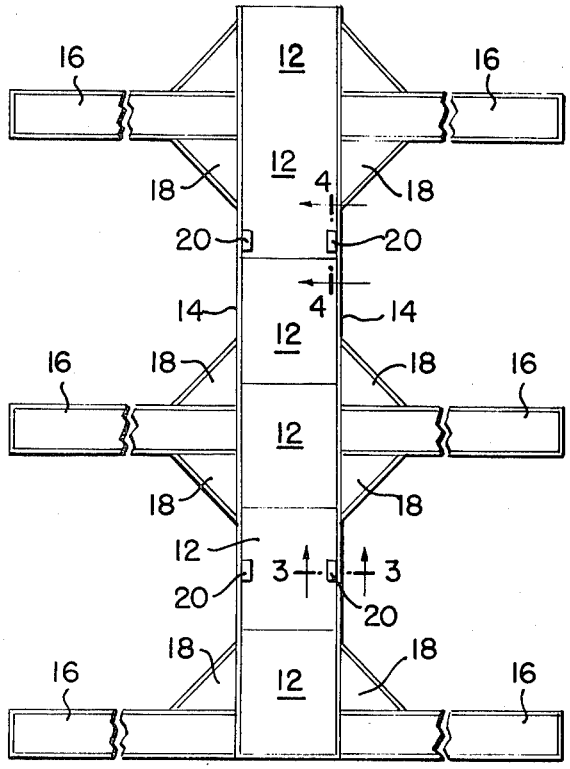
FIG. 1
FIG. 2
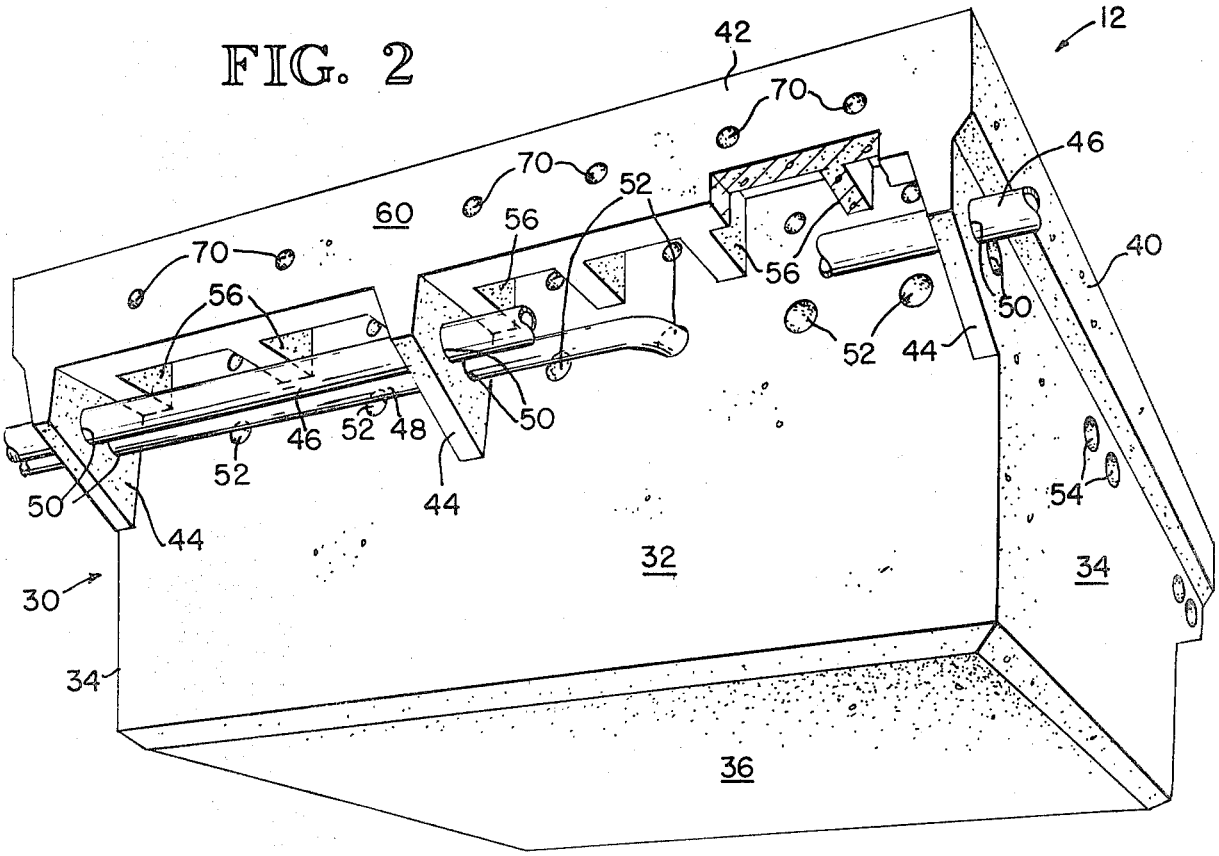

CONCRETE MARINE FLOAT HAVING UTILITY DISTRIBUTION SYSTEM

DESCRIPTION

1. Technical Field

This invention relates to vessel mooring facilities and, more particularly, to a concrete marine float having a self-contained utility distribution system.

2. Background Art

Floating moorage facilities utilizing a large number of interconnected marine floats are in common use. Such floats usually comprise a concrete casing and deck surrounding a buoyant core, normally of a lightweight foam. Vessels moored adjacent such floats generally require utility services, such as electricity, water, sewage, and telephone. In the past, such utility services have been routed to vessels through various utility distribution structures. For example, some concrete marine floats utilize an open utility trench extending along the deck of the float which is covered by a removable plate during use. Another approach utilizes utility conduits suspended beneath wales that extend along the sides of the floats to fasten the floats to each other.

Existing utility distribution techniques have generally been satisfactory. However, boat owners have been demanding an increasing number of utility services. For example, while water, electric and sewage services have normally been supplied by most well-equipped marinas, boaters are now demanding telephone, dry chemical fire protection, TV cable and multivoltage power services. Existing utility distribution systems are not capable, and cannot easily be made capable, of accommodating these additional services. For example, wales interconnecting floats have a finite width, thus limiting the thickness or number of the utility conduits that can be positioned beneath them. Utility trenches could be made wider to accommodate the additional utility services, but this would unduly increase the cost of such floats and the resulting deck would be greatly cluttered by cover plates.

DISCLOSURE OF THE INVENTION

It is an object of the invention to provide a concrete marine float having a self-contained utility distribution system that is capable of accommodating virturally every utility demanded by boaters.

It is another object of the invention to provide a concrete marine float having a self-contained utility distribution system that has a relatively large deck for a given size casing.

It is still another object of the invention to provide a concrete marine float which allows a great deal of flexibility in the routing of utility conduits to utility distribution outlets.

It is a further object of the invention to provide a concrete marine float having a self-contained utility distribution system that allows floats to be interconnected through a variety of fastening techniques.

These and other objects of the invention are provided by a concrete marine float having a concrete casing surrounding a buoyant foam core. The casing is covered by a generally rectangular deck having a width that is substantially greater than the width of the casing so that overhanging flanges are formed on opposite sides of the casing. The flanges are supported by a plurality of spaced-apart gussets extending from the sidewalls of the casing to the underside of the deck. Utility conduits extend along at least one side of the casing beneath the flange. The utility conduits are supported by the gussets, preferably by extending through a series of aligned apertures in the gussets. The float preferably has formed therein a plurality of transverse passages at the same elevation as the utility conduits to allow utility lines to pass through the float from one side to the other. The deck may be of uniform thickness, but it is preferably formed by a reinforcing grid extending downwardly from an integrally formed deck plate so that portions of the deck are relatively thin. These relatively thin portions allow apertures to be easily formed in the deck in order to route the utility conduit to utility outlets mounted on the deck. A relatively thick beam intergrally formed with the deck preferably extends along the side of the deck in order to reinforce it against side loads. The floats may be interconnected by a variety of structures, such as wales extending along the beams between adjacent floats. The wales may be fastened to the float by either through-rods extending transversely through the float or by bolts extending from the inside of the beam through the wales.

BRIEF DESCRIPTION OF THE DRAWINGS

FIG. 1 is a top plan view of a floating moorage facility that may be formed by the concrete marine floats having a self-contained utility distribution system.

FIG. 2 is an isometric view of one of the marine floats.

BEST MODE FOR CARRYING OUT THE INVENTION

Figure 3:
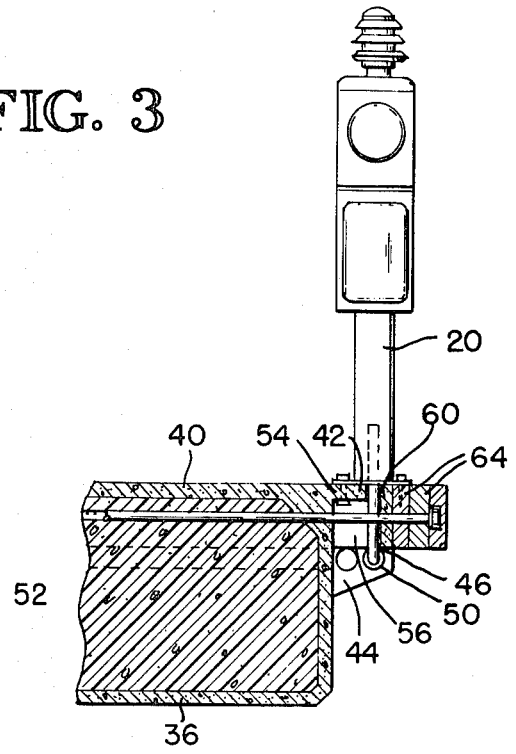
FIG. 3 is a cross-sectional view taken along the line 3—3 of FIG. 1.

A moorage facility constructed with the floats is illustrated in FIG. 1. Serveral of the inventive floats 12 are arranged end-to-end to form an elongated mainwalk. The floats 12 are interconnected by overlapping wales 14 which are fastened to the floats 12 by conventional means, such as by tie rods. A plurality of mainwalk floats 16 project perpendicularly from opposite sides of the mainwalk floats 12 at spaced-apart intervals. The finger floats 16 are secured to the mainwalk floats by triangularly shaped gussets 18.

In use, vessels are positioned adjacent opposite sides of the finger floats. The vessels then receive utility service from conventional utility outlets 20 which are mounted on some of the mainwalk floats 12. This utility service can include such commonly supplied services as AC power, sewage, and water, as well as increasingly demanded utilities, such as telephone, chemical and water fire protection, TV cable, and the like. These utilities are routed to the utility outlets 20 through utility conduits extending beneath overhanging flanges formed in the mainwalk floats 12 adjacent the mainwalk wales 14.

The structural details of the inventive mainwalk floats 12 are best illustrated in FIGS. 2 and 3. The float 12 includes a casing 30 of concrete forming opposed sidewalls 32, end walls 34, and a bottom 36. The casing 30 surrounds a buoyant core 38, generally of a lightweight foam such as polystyrene. The casing 30 is covered by a deck 40 which has a width that is substantially larger than the width of the casing 30 so that overhanging flanges 42 are formed on opposite sides of the float 12. The flanges 42 are supported by gussets 44 which extend from the sidewall 32 of the casing 30 to the underside of the flanges 42. The flanges 42 also serve to support utility conduits 46,48, preferably by forming aligned apertures 50 in the gussets 44 through which the conduits 46,48 pass. As best illustrated in FIG. 2, one of the utility conduits 28 is bent inwardly and passes through one of a plurality of transverse passages 52 formed in the casing 30. The transverse passages 52 allow the utility conduits to be routed from one side of the mainwalk floats 12 to the other so that it is not necessary to place utility conduits on both sides of the floats 12.

Longitudinal passages 55 are also formed in the casing 30 to route utility lines along the mainwalk floats 12.

The deck 40 may be of uniform thickness. However, it is preferably formed by a relatively thin plate 54 covering an integrally formed reinforcing grid 56. The reinforcing grid 56 preserves the strength of the deck 40 while allowing the plate 54 to be relatively thin, thereby allowing holes to be formed in the plate 54 for the passage of utility conduits with relative ease. A deck of uniform thickness would have to be substantially thicker than the plate 54 used with the reinforcing grid 56, thus making it more difficult to route utility conduits through the deck 40. Regardless of which deck structure is used, "knockout" plugs may be formed in the deck to allow passages to be formed in the deck with relative ease.

As illustrated in FIGS. 2 and 3, the deck 40 is integrally formed with the casing 30. However, under some circumstances, it may be desirable to utilize a casing 30 that is fabricated independently of the deck 12. For example, the casing 30 is relatively light, but it requires a great deal of manufacturing skill to fabricate. The deck 12, on the other hand, is fairly heavy, but, in its simplest form, can be fabricated with relative ease. Thus, when the floats 12 are to be installed at a remote location, it may be desirable to fabricate the casings 30 at a factory and ship them to the installation site while fabricating the deck 40 at the site. The deck 40 is then bonded to the casing 30 by suitable means.

A horizontal beam 60 is preferably formed along each side edge of the flange 42. The beam 60 may be either integrally formed with the deck 40 or it may be an entirely separate structure. The beam 60 serves a number of functions. First, it gives the float additional strength in the area where it is likely to receive blows from vessels. Second, it provides a flat bearing area for timber wales to rest against where the floats 12 are interconnected by wales, as explained above. Third, it allows the wales to be secured to the float by either through-rods extending through apertures 70 in the beam 60 from one side of the float to the other or by bolts extending through the apertures 70 from the inside of the beam 60. The strengthening function of the beam 60 makes it desirable for the beam to be reinforced with suitable reinforcing mesh before it is cast.

Figure 4:
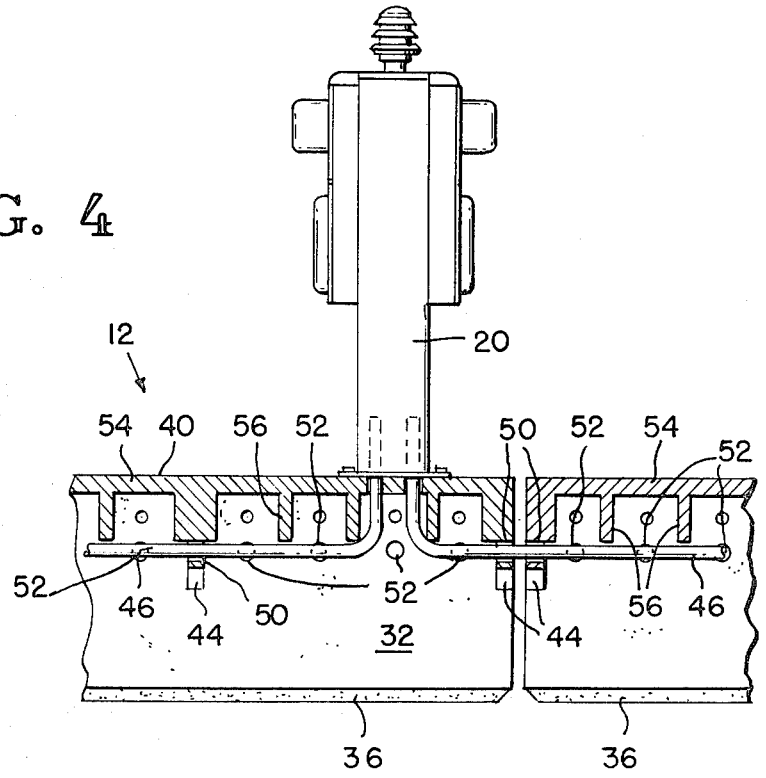
FIG. 4 is a cross-sectional view taken along the line 4—4 of FIG. 1.

The utility conduits 46,48 are routed to the conventional utility outlets 20, as illustrated in FIGS. 3 and 4. An aperture is formed in the deck plate 54 between adjacent members of the grid 56 by suitable means. The utility outlet 20 is then mounted on the upper surface of the deck plate 54 above the aperture by suitable means, such as by bolting or bonding. The utility conduits 46 extending beneath the flange 42 are then bent upwardly and terminate in the utility outlet 20. The flange 42 can be made sufficiently wide to provide enough room to accommodate virtually any utility conduit demanded by boaters. Furthermore, this complete utility service is provided in a manner that is completely inconspicuous, thereby preserving the clean appearance of the deck service.

I claim:

1. A moorage facility adapted to route utility service to vessels moored at said facility, said facility comprising:

a plurality of marine floats arranged end-to-end in a row, eacch of said floats having a concrete casing surrounding a buoyant core and a deck covering said casing, said deck having a width that is substantially greater than the width of said casing to form a flange that overhangs the sides of said casing;

a utility outlet mounted on the deck of at least one of said floats;

a utility conduit extending along at least one side of said floats beneath said flange, said conduit being supported by gussets integrally formed with said casing at spaced apart locations, the conduits being substantially exposed and accessible from the side of the float intermediate said support location, said conduit extending upwardly through said deck to connect with said utility outlet, thereby supplying utility service to vessels moored adjacent said float;

fastening means for interconnecting said floats.

2. The moorage facility of claim 1 wherein said support comprises a plurality of longitudinally spaced gussets extending from the sidewalls of said casing to the underside of said deck to support said flange and utility conduits.

3. The moorage facility of claim 2 wherein said gussets are integrally formed with said deck and casing.

4. The moorage facility of claim 2 wherein aligned holes are formed in said gussets and said utility conduits pass through said aligned holes in order to support said conduits.

5. The moorage facility of claim 2, further including a reinforcing beam extending horizontally along each side edge of said deck.

6. The moorage facility of claim 5 wherein the outer surface of said beam is substantially planar and said fastening means includes a wale extending along each side of said float, said wales being secured thereto by through-rods extending from one side of said float to the other, with their ends projecting through said wales.

7. The moorage facility of claim 5 wherein the outer surface of said beam is substantially planar and said fastening means includes a wale extending along each side of said float, said wales being secured thereto by bolts extending from the inner surface of said beam through said wales.

8. The moorage facility of claim 1 wherein said deck comprises a reinforcing grid extending downwardly from an integrally formed deck plate whereby the strength of said grid allows said deck plate to be relatively thin in order to facilitate opening of said deck plate between said grid to route said utility conduit to said utility outlet.

9. The moorage facility of claim 1, further including a plurality of transverse passages extending across said float at the same elevation as said utility conduits to allow said utility conduits to pass through said float from one side to the other.

10. The moorage facility of claim 1 wherein said casing and deck are separate, integrally formed structures that are bonded to each other.

11. A marine float having a self-contained utility distribution system, said float comprising:

a concrete casing surrounding a buoyant foam core, said casing being covered by a generally rectangular deck having a width that is substantially greater than the width of said casing to form a flange that overhangs the sides of said casing;

a plurality of longitudinally spaced gussets extending from the sidewalls of said casing to the underside of said deck to support to said flange and utility conduits said gussets integrally formed with said casing; and a utility conduit extending along at least one side of said float beneath said flange, said utility conduit being supported by said gussets while being substantially exposed and accessible from the side of the float for easy routing and servicing and intermediate said gussets.

12. The marine float of claim 11 wherein said utility conduit passes through respective aligned apertures formed in said gussets.

13. The marine float of claim 11, further including a plurality of transverse passages extending through said deck adapted to receive respective tie rods for securing a plurality of said floats to each other.

14. The marine float of claim 11 wherein said deck comprises a reinforcing grid extending downwardly from an integrally formed deck plate whereby the strength of said grid allows said deck plate to be relatively thin in order to facilitate opening said deck plate between said grid to route said utility conduit above said deck.

15. The marine float of claim 11, further including a plurality of transverse passages extending across said float at the same elevation as said utility conduit to allow said utility conduit to pass through said float from one side to the other.

* * * * *